US005609508A

United States Patent [19]

Wingate

[11] Patent Number: 5,609,508

[45] Date of Patent: Mar. 11, 1997

[54] TOY TELEPHONE WITH VISUAL DISPLAY FOR RECORDED MESSAGES

[75] Inventor: Richard C. Wingate, Scarsdale, N.Y.

[73] Assignees: Sony Corporation, Japan; Sony Electronics Inc.

[21] Appl. No.: 546,770

[22] Filed: Oct. 23, 1995

[51] Int. Cl.[6] ..... A63H 33/30; A63H 5/00

[52] U.S. Cl. ..... 446/142; 446/404; 345/122; 379/110; 379/354

[58] Field of Search ..... 365/45; 369/33.1, 369/13, 15, 31, 64, 68; 379/110, 67, 88, 89, 354; 360/33.1, 13, 15; 446/141, 142, 143, 297, 219, 404, 485; 345/122

[56] References Cited

U.S. PATENT DOCUMENTS

| | | | |
|---|---|---|---|
| 3,594,941 | 7/1971 | Handler et al. . | |
| 3,771,255 | 11/1973 | Carabet et al. | 369/31 |
| 4,232,267 | 11/1980 | Hanajima et al. . | |
| 4,237,650 | 12/1980 | Goldfarb | 446/141 X |
| 4,421,954 | 12/1983 | Mita et al. . | |
| 4,436,959 | 3/1984 | Nakatsuyama et al. . | |
| 4,549,047 | 10/1985 | Brian et al. . | |
| 4,777,938 | 10/1988 | Sirota | 369/31 X |
| 4,782,522 | 11/1988 | Kramer et al. | 379/428 X |
| 4,920,556 | 4/1990 | Wong | 379/51 |
| 4,926,484 | 5/1990 | Nakano . | |
| 4,959,037 | 9/1990 | Garfinkel | 446/229 |
| 5,081,672 | 1/1992 | Mita et al. . | |
| 5,113,493 | 5/1992 | Crosby | 345/122 X |
| 5,163,082 | 11/1992 | Karnowski . | |
| 5,218,633 | 6/1993 | Clagett et al. | 379/110 X |
| 5,283,818 | 2/1994 | Klausner et al. | 379/199 X |
| 5,289,529 | 2/1994 | Karnowski . | |
| 5,373,551 | 12/1994 | Baals et al. | 379/110 |
| 5,374,952 | 12/1994 | Flohr . | |
| 5,375,160 | 12/1994 | Guidon et al. | 379/52 |

FOREIGN PATENT DOCUMENTS

| | | | |
|---|---|---|---|
| 2413101 | 8/1979 | France | 446/142 |

OTHER PUBLICATIONS

AT&T, Touch–A–Matic, Apr. 1985, publiched by CITGO. 379–110.

*Primary Examiner*—Robert A. Hafer
*Assistant Examiner*—D. Neal Muir
*Attorney, Agent, or Firm*—Ronald P. Kananen

[57] ABSTRACT

In order to improve the effects which can be achieved with pre-recorded data, a toy telephone is provided with a suitable display such as a LCD. A suitable memory (e.g. IC memory) is included in the telephone enabling both audio and image data to be recorded by parents or the like, and played back in response to the manipulation of one or more of the buttons provided on the numerical key pad. A programmable timer is included in the device allowing calls containing suitable instructions or greetings to be "placed" to children at appropriate times.

6 Claims, 2 Drawing Sheets

TOY TELEPHONE WITH VISUAL DISPLAY FOR RECORDED MESSAGES

BACKGROUND OF THE INVENTION

1. Field of the Invention

The present invention relates generally to a toy telephone. More specifically, the present invention relates to a toy telephone which contains pre-recorded messages and which can display visual images synchronously with the audio messages.

2. Description of the Related Art

U.S. Pat. No. 4,104,821, issued on Aug. 8, 1978 in the name of Nakajima, discloses a battery operated toy telephone which includes a record-like disc on which pre-recorded messages are imprinted and which allows the messages to be randomly selected and reproduced using a electromechanical device including a needle type stylus.

This arrangement however, suffers from the drawback that individualized messages cannot be recorded and that the messages are limited to those which are imprinted on the surfaces of disc.

U.S. Pat. No. 5,184,971, issued on Feb. 9, 1993 in the name of Williams, discloses a slightly more sophisticated toy telephone arrangement wherein a plurality of messages can be recorded on a corresponding plurality of message chips included in the device. This of course enables highly personalized messages to recorded for a child's entertainment or benefit.

However, while this arrangement is such that suitable pictures can be placed under transparent plastic caps which snap onto the tops of each of the key pad buttons, this arrangement is totally limited to the recordation of audio messages.

SUMMARY OF THE INVENTION

It is an object of the present invention to provide a toy telephone which can selectively display images in synchronism with recorded audio messages.

It is a further object of the present invention to provide a toy telephone which can be programmed to ring at predetermined times and to display a predetermined image or images while generating a corresponding predetermined audio message in response to the "call" being answered.

In brief, the above objects are achieved by a toy telephone which is provided with a suitable display such as a LCD. A suitable memory (e.g. an IC memory) is included in the telephone enabling both audio and image data to be recorded by parents or others, and played back in response to the manipulation of one or more of the buttons provided on the numerical key pad. A programmable timer is included in the device allowing calls containing suitable instructions or greetings to be "placed" to children at appropriate times.

More specifically, a first aspect of the present invention resides in a toy telephone which features: a main body; a display disposed on the main body; a handset in which a first speaker is disposed; a key pad having a plurality of manually manipulable buttons, the key pad being disposed on the main body; memory means in which image data and audio data can be stored; and control means operatively connected with the key pad, the memory, the first speaker in the handset, and the display, the control means being responsive to the manipulation of one or more of the plurality of buttons on the key pad in a manner to read out predetermined image and audio data from the memory and direct the image data and the audio data to the display and first speaker, respectively.

A further aspect of the present invention resides in that the above mentioned toy telephone further features: a second speaker disposed in the main body; and a programmable timer which can be set to produce a trigger signal which induces the control means to energize the second speaker and to read out predetermined image and audio data from the memory and supply the image and audio data to the display and the first speaker.

Another aspect of the invention resides in a toy telephone of the nature set forth above and which further comprises an interface means for interfacing an external source of image and audio data with the memory and for permitting data from the external source to be supplied to and recorded in the memory.

Another aspect of the invention resides in a toy telephone wherein the above mentioned control means is operatively connected with the interface means and responsive to the manual manipulation of a first predetermined combination of buttons on the key pad to permit data from the external source to be supplied to and recorded in the memory.

A still further aspect of the present invention resides in a toy telephone of the nature set forth above wherein the programmable timer is responsive to the manipulation of a second combination of buttons on the key pad in a manner which allows the timer to be programmed to produce the trigger signal at a predetermined time and to identify which image and audio data is to be read out of the memory.

Another aspect of the invention resides in that the above mentioned toy telephone further comprises a write protect switch which is provided on a predetermined location of the main body and operatively connected with the control means for selectively preventing existing image and audio data from being accidently written over.

BRIEF DESCRIPTION OF THE DRAWINGS

The various features and advantages of the present invention will become more clearly appreciated as a detailed description of an embodiment of the invention is given with reference to the appended drawings in which.

DETAILED DESCRIPTION OF THE PREFERRED EMBODIMENTS

Figure 1:
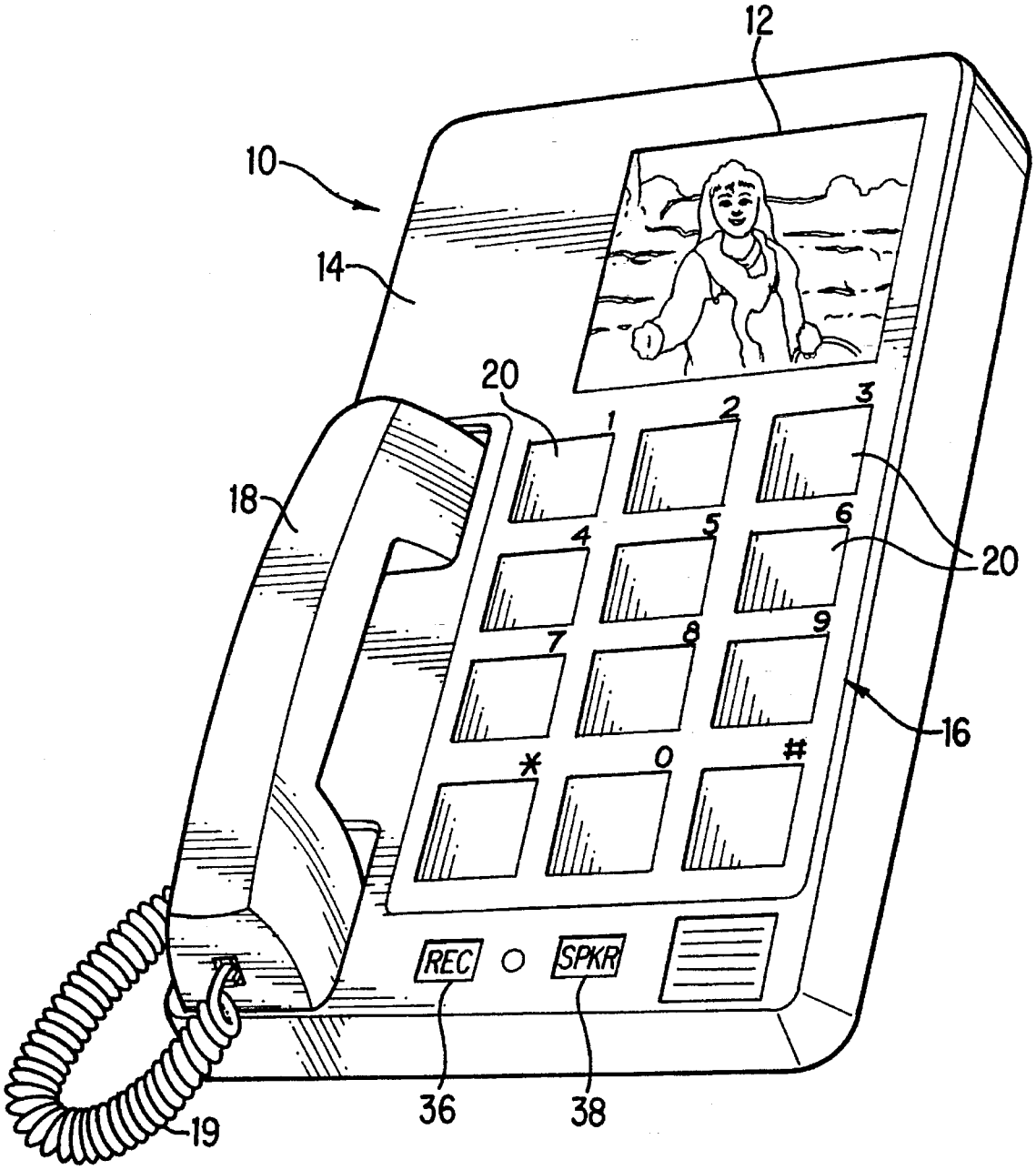
FIG. 1 is a perspective view of a toy telephone according to a first embodiment of the invention.
Figure 2:
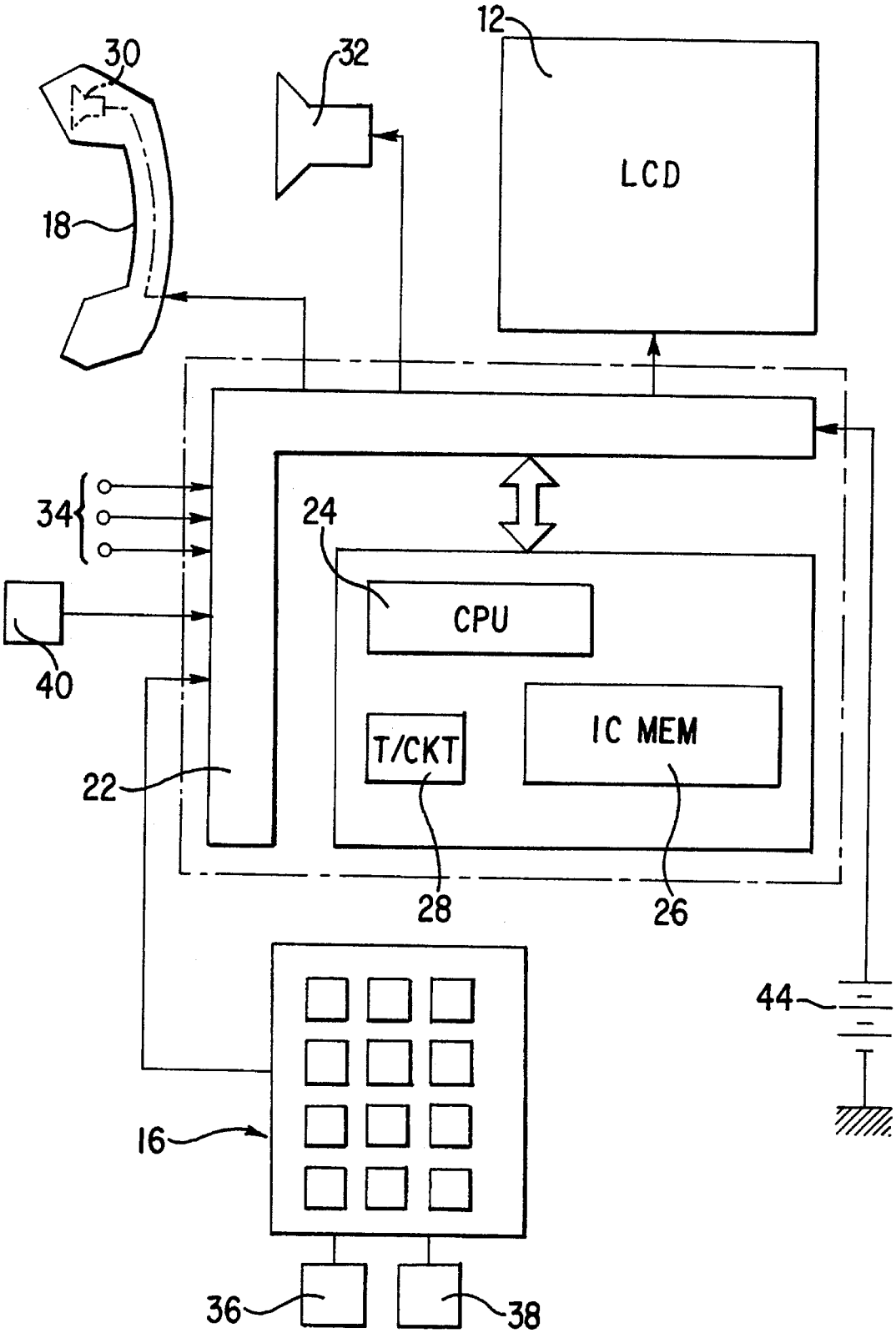
FIG. 2 is a schematic circuit diagram showing an arrangement which operatively interconnects the key pad provided on the main body of the telephone and the LCD display.

FIGS. 1 and 2 show an embodiment of the present invention. In this arrangement a toy telephone 10 is provided with a LCD type display 12 which is, in this embodiment, arranged on the main body 14 of the toy telephone above a key pad 16 and in a highly visible position. Other than the provision of the LCD type display 12 (hereinafter simply LCD), the shape and arrangement of the toy phone 10 is conventional so as to impart a completely realistic appearance. For example, in this embodiment the handset 18 is connected to the main body of the telephone by a flexible helical coil cable 19.

Each of the buttons 20 on the key pad 16 are arranged to be relatively large and to have transparent snap off covers (not shown) to allow pictures of people and the like to be cut-out and placed on top of the keys so as to enable a young child to readily identify which button needs to be pressed in order to achieve the generation of a given message.

FIG. 2 schematically shows a circuit arrangement which includes an I/O interface 22, a central processing unit (CPU) 24, an IC memory 26 and a programmable timer (T/CKT) 28, and which can be used in accordance with the first embodiment. A will be appreciated, this circuit arrangement is operatively connected with the LCD 12; a small speaker 30 included in the handset 18; a larger speaker 32 which is housed in the main body of the telephone; and the key pad 16. The circuit is also provided with an interface 34 in the form of three ports via which audio and image data can be supplied to the circuit arrangement from an external source (not shown). The IC memory 26 can take any suitable form, however requires a larger capacity than is normally provided in tapeless types of telephone answering machines in order to accommodate the additional image data which is needed to produce the required images on the LCD 12. Factors effecting the size of the memory are color and type of image. In this embodiment the LCD 12 is capable of producing only black and white (monochrome) images which require less memory space than images containing a large number of colors. Moving or animated images also require much more space than still frames. Accordingly, depending on the effect that is required and the size and type of the memory 26 and the LCD 12 which are available at acceptable costs, it is within the scope of the invention to provide moving color images which can suitably move for a short period of time while the audio message is being played.

The arrangement depicted in FIG. 2 further includes a record switch or button 36 for controlling the recordation of new data in the memory and speaker control switch or button 38 for enabling or disabling the speaker 32. This latter mentioned speaker switch 32 enables a child to switch between the use of the speaker 30 in the handset 18, and speaker phone situation wherein the audio message is fed to the larger speaker 32. A write protect switch 40 is provided to enable the interface 34 to be selectively disabled and to safeguard data which is already written into memory, against being overwritten. This switch 40 is preferably located in position which is not readily accessible such as on the bottom of the main body 14 proximate a cover which allows batteries (schematically depicted at 44 in FIG. 2), to be replaced, in order to prevent accidental manipulation and possible loss of memorized data.

In light of the recent advances in computer techniques and software for treating image data and for modifying image data such as that which can obtained directly from a VCR deck, or electronic cameras which can be take still photos and store the same in digital format, the various image possibilities which can be loaded into the memory of the telephone according to the present invention is vast. Depending on the amount of memory available, it may be preferred to have only one or two moving images and store the remainder in still form. The age of the child is also of importance and will effect the content of the displayed images and audible messages.

In the event that the IC memory 26 actually comprises a number of memory chips, one for each of a predetermined number of messages that can be recorded, in the manner described in U.S. Pat. No. 5,184,971 issued on Feb. 9, 1993 in the name of Williams, it is within the scope of the present invention to record both the image and audio data on the same chip and to induce the reproduction of the data in response to the manipulation of the designated button or buttons. Alternatively, if all of the data is stored in a single large capacity memory, the audio data and the image data must be simultaneously located and read out. As this type of programming is well within the purview of a person skilled in the IC memory/computer art no further description pertaining to this aspect of the invention is believed necessary.

In order that the required image and audio data be supplied and suitably recorded, three data input ports (interface 34) are provided in a side of the main body. In this embodiment, the three ports are the same as those used in connection with VCR type apparatus to allow for data to be supplied directly from a portable camera, personal computer, or the like. By way of example only, the circuit arrangement can be arranged to record data in response to the record button 36 and a selected one (or more) of the other thirteen buttons which are provided on the key pad 16, being simultaneously depressed while the signal is being supplied to the data input ports from a suitable external source.

The present invention is not limited to reproducing images in response to key pad manipulation. The programmable timer 28 is provided to enable a parent, for example, to program the telephone 10 to ring at a predetermined time and for a predetermined message to be read out of memory. By way of example, the telephone 10 can be programmed to ring at 8:00 pm and a message telling a child that "it is time for bed" or the like can be induced to play. This feature of the invention may prove quite useful in instances wherein a given parent(s) is absent and the ability to produce an image of the parent(s) in question may prove very reassuring to the child.

It must be appreciated that the circuit arrangement which is illustrated in FIG. 2 is schematic and that the present invention is in no way limited to such a configuration.

The various modification to the disclosed embodiment that are possible will be self-evident to those skill in the art to which the present invention pertains. For example, the present invention is not limited to the three data port interface arrangement mentioned above and a number of different interfacing arrangements may be utilized. The present invention is not limited to hard memory chips or the use of CMOS RAM, EPROM, EEPROM, and super compact hard discs, DAT type tapes and the like can be used if preferred. As an alternative to the LOD type display, it is within the scope of the invention to use LED or the like type technology.

It should be further noted that while the disclosed embodiment is essentially based on telephone answering machine (TAM) technology, the present invention can alternatively be based on a handicam technology and make use of 8 mm video tape as a memory. While the power consumption incurred by driving a tape is much higher than that involved with the above mentioned type of hard memory, the amount of image data which can be stored is vastly increased. Further the ease with which messages could be recorded and transferred to the telephone would be increased. By generating (e.g. synthesizing) suitable noises such as a dial tone which occurs when waiting for a dialed party to answer their phone, it is possible to provide a suitable period in which the tape can be wound to a position in which the desired message is recorded and thus achieve a good degree of realism. The power consumption problem can be overcome by providing the telephone with a power connector cord which could be plugged into a power outlet, or an increased number of dry cells to power the device.

For further details relating to circuitry for telephone answering machines, reference may be had to: U.S. Pat. No. 5,081,672 issued on Jan. 14, 1992 in the name of Mira et al.; U.S. Pat. No. 5,163,082 issued on Nov. 10, 1992 in the name of Karnowski; U.S. Pat. No. 4,421,954 issued on Dec. 20, 1983 in the name of Mita et al.

What is claimed is:

1. A toy telephone comprising:

a display disposed on a main body of said toy telephone;

a handset in which a first speaker is disposed, said handset being supported on the main body of said toy telephone;

a key pad having a plurality of manually manipulable key, said key pad being disposed on the main body;

memory means for storing moving or animated image data and audio data, each of said keys being linked to an individual segment of said memory means; and control means operatively connected with said key pad and each of said keys, said memory means, the first speaker in said handset and said display, said control means being responsive to the manipulation of any one of said plurality of keys on the key pad in a manner to read out predetermined moving or animated image and audio data from said memory means the individual segment and direct the moving or animated image data and the audio data to said display and first speaker respectively.

2. A toy telephone as set forth in claim 1, further comprising:

a second speaker disposed in the main body; and a programmable timer which can be set to produce a trigger signal which induces said control means to energize said second speaker and to read out predetermined image and audio data from said memory means and supply the image and audio data to the display and the first speaker.

3. A toy telephone as set forth in claim 1, further comprising interface means for interfacing an external source of moving or animated image data and audio data with said memory means and for permitting data from the external source of moving or animated image data and audio data to be supplied to said display and said handset, respectively.

4. A toy telephone as set forth in claim 3, wherein said control means is operatively connected with said interface means and responsive to the manual manipulation of a first predetermined combination of keys on said key pad to permit data from the external source to be supplied to and recorded in said memory means.

5. A toy telephone as set forth in claim 2, wherein said programmable timer is responsive to the manipulation of a second combination of keys on said key pad in a manner which allows said timer to be programmed to produce said trigger signal at a predetermined time and to identify which image and audio data is to be read out of said memory means.

6. A toy telephone as set forth in claim 1, further comprising a write protect switch which is provided on a predetermined location of the main body and operatively connected with said control means for selectively preventing existing image and audio data from being accidently written over.

* * * * *